US008122543B2

(12) United States Patent
Kenalty et al.

(10) Patent No.: US 8,122,543 B2
(45) **Date of Patent: *Feb. 28, 2012**

(54) EVACUATION MATTRESS

(76) Inventors: Christopher Kenalty, Toronto (CA); Miriam Gordon, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/187,946

(22) Filed: Jul. 21, 2011

(65) Prior Publication Data

US 2011/0271445 A1 Nov. 10, 2011

Related U.S. Application Data

(63) Continuation of application No. 12/819,631, filed on Jun. 21, 2010, now Pat. No. 8,006,334, which is a continuation of application No. 12/134,432, filed on Jun. 6, 2008, now Pat. No. 7,774,877.

(51) Int. Cl.

| | |
|---|---|
| ***A61G 1/013*** | (2006.01) |
| ***A61G 1/01*** | (2006.01) |
| ***A61G 1/02*** | (2006.01) |
| ***A61G 7/08*** | (2006.01) |

(52) U.S. Cl. ..... 5/626; 5/627; 5/628; 5/81.1 R; 5/494

(58) Field of Classification Search ..... 5/625–629, 5/81.1 R, 81.1 HS, 494; 128/869, 870, 872, 128/873

See application file for complete search history.

(56) References Cited

U.S. PATENT DOCUMENTS

| | | | | |
|---|---|---|---|---|
| 4,736,474 | A | 4/1988 | Moran et al. | |
| 5,016,299 | A | 5/1991 | Boulanger | |
| 5,150,487 | A | 9/1992 | Hemphill | |
| 5,189,746 | A | 3/1993 | Horie | |
| 5,249,321 | A | 10/1993 | Graf | |
| 7,055,190 | B2 | 6/2006 | Barth et al. | |
| 7,216,378 | B2 | 5/2007 | Barth et al. | |
| 7,559,103 | B2 | 7/2009 | Barth et al. | |
| 7,610,640 | B2 | 11/2009 | Post | |
| 7,774,877 | B2 | 8/2010 | Kenalty et al. | |
| 8,006,334 | B2 * | 8/2011 | Kenalty et al. | 5/626 |
| 2005/0246833 | A1 | 11/2005 | Barth et al. | |
| 2006/0200905 | A1 | 9/2006 | Barth | |
| 2008/0301876 | A1 | 12/2008 | Kenalty et al. | |
| 2010/0251479 | A1 | 10/2010 | Kenalty et al. | |
| 2011/0271445 | A1 * | 11/2011 | Kenalty et al. | 5/81.1 R |

FOREIGN PATENT DOCUMENTS

WO 8607253 A1 12/1986

* cited by examiner

*Primary Examiner* — Robert G Santos

(74) *Attorney, Agent, or Firm* — Katten Muchin Rosenman LLP

(57) ABSTRACT

An evacuation mattress comprises an integral mattress including a mattress interior, a mattress top face sheet, four mattress side face sheets, and a bottom sheet. The bottom sheet forms both the mattress bottom face sheet and an evacuation bottom sheet. The integral evacuation mattress also includes a top evacuation sheet configured to be deployed over a patient who is disposed above the mattress top face sheet. The integral evacuation mattress further includes securing structure configured to secure the top evacuation sheet to the patient and the integral mattress. Transport structure is also included in the integral evacuation mattress and is configured for a person to drag the secured patient and integral mattress from a hospital.

20 Claims, 16 Drawing Sheets

EVACUATION MATTRESS

This application is a continuation of U.S. patent application Ser. No. 12/819,631, filed Jun. 21, 2010, now U.S. Pat. No. 8,006,334, issued Aug. 30, 2011, which is a continuation of U.S. patent application Ser. No. 12/134,432, filed Jun. 6, 2008, now U.S. Pat. No. 7,774,877, issued Aug. 17, 2010, the contents of both incorporated herein by reference.

BACKGROUND OF THE INVENTION

1. Field of the Invention

The present invention relates to an evacuation mattress for bed-ridden patients. More particularly, the invention relates to such a mattress in which a patient may be rapidly and securely enclosed in a mattress-cocoon for rapid evacuation from hospitals in an emergency, preferably by a single care-giver.

2. Description of the Related Art

In emergencies, non-ambulatory or bed-ridden patients must be quickly and safely evacuated from hospitals and other care facilities. During the Hurricane Katrina floods in New Orleans in 2005, the inability to quickly evacuate such patients was starkly apparent. Hospital and care facilities all over the world are now preparing for the emergency evacuation of bed-ridden patients. One solution for this demand is to use so-called "evacuation sleds" to remove patients from hospitals. While many sled-type patient evacuation devices are known (such as the evacuation sled disclosed in U.S. Patent Publication No. 2007/0278754 to Walkingshaw), these sleds require several care-givers to transfer the patient from his/her bed into the sled for evacuation. The sleds are then dragged through the hospital, down numerous flights of stairs, and then to an evacuation center where the patient waits (often for hours) for transportation to another hospital, where the patient must be removed from the sled and placed in another bed (again requiring several care-givers). This leads to problems such as contusions in the patient from being bounced down steps, patient hypothermia, and the necessity for many care-givers to perform the multiple patient-transfer steps. U.S. Pat. No. 5,249,321 to Graf solves many of these problems by disposing patient evacuation sheets underneath the hospital bed mattress. In an emergency, a single care-giver may pull the sheet ends up and over the patent's head and body, tighten down the sheets, and then evacuate the patent (while still on the mattress) down the stairs and out of the hospital. This system, however, requires the sheets to be properly disposed and positioned beneath the mattress. Also, mattresses vary in size and certain sizes may be unsuited for such sheets.

An Evacuation Mattress is disclosed in U.S. Pat. No. 5,150,487 to Hemphill, where a rescue device is disposed beneath a patient mattress. However, such a device suffers from the same problems noted above. See also International Application Number PCT/NL 86/00015 published Dec. 18, 1986 under No. WO 86/07253 based on a Netherlands application filed Jun. 12, 1985. The mattress is characterized by belts or ropes that pass through an interior of the mattress and are then fixed about the patient. However, it can not be expected that mere straps will properly encase the patient and his/her bedding for long. Also, dragging the mattress bottom over floors, concrete, and soil may be impractical.

Other known structures for evacuating non-ambulatory persons include boards or mats to support the patient. For example, U.S. Pat. No. 4,793,008 to Johansson discloses rigid mats with straps, respectively placed beneath the patient's chest and thighs. A relatively complicated Rescue Transportation Mattress is disclosed in U.S. Pat. No. 4,736,474 to Moran et al, wherein an inflatable support member and crossed straps are used to secure the person being transported. Again, such solutions do little for a quick, safe, and warm evacuation of a patient from a facility during an emergency.

A child Restraint Mattress With Removable Semi-Rigid Support is disclosed in U.S. Pat. No. 4,627,428 to Brooks. It includes a semi-rigid base and a sheet attachable to the base so as to secure the child between the base and the sheet. A restraining harness on top of the sheet secures the entire arrangement to a transporting mattress. A similar system is disclosed in U.S. Pat. No. 7,216,378 to Barth, in which a sleeve may enclose the patient and mattress for transport. U.S. Patent Pub. No. 2007/0289066 to Davis discloses a bifurcated mattress with straps to enclose the patient. As with the above, such solutions have been found lacking as a comprehensive solution to the emergency evacuation problem for bed-bound patients.

There are numerous other patents and patent applications employing rigid or semi-rigid supports and belts or straps to secure the person transported to the support. One apparent disadvantage to the use of straps or belts is that they could exert undue or excessive pressure on particular locations on the bodies of some evacuees, such as in the case of recent surgery patients. Another disadvantage that is not obvious is that the use of many straps, harnesses, buckles, etc., delays the process of readying the patient for rescue and evacuation such as in the case of a hospital fire.

Thus, what is needed is an emergency evacuation mattress for bed-ridden patients, that is capable of operation by a single care-giver, provides a warm and secure cocoon for the patient, allows easy transport over any type of surface, provides proper support for all of the patient's body and bedding, and allows the patient to feel a high degree of comfort in what is otherwise a very stressful situation.

SUMMARY OF THE INVENTION

The present invention endeavors to provide a rescue/evacuation mattress that is rapidly deployable and that does not adversely affect the patient's body once deployed, and permits evacuation thereof by one person if necessary.

In one aspect of the invention, an evacuation mattress comprises an integral mattress including a mattress interior, a mattress top face sheet, four mattress side face sheets, and a bottom sheet, the bottom sheet forming the mattress bottom face sheet and an evacuation bottom sheet. The integral evacuation mattress also includes a top evacuation sheet configured to be deployed over a patient who is disposed above the mattress top face sheet. The integral evacuation mattress further includes securing structure configured to secure the top evacuation sheet to the patient and the integral mattress. Transport structure is also included in the integral evacuation mattress and is configured for a person to drag the secured patient and integral mattress from a hospital.

In another aspect, the present invention relates to an evacuation mattress comprising an integral, one-piece mattress that includes: (i) a mattress interior; (ii) a mattress top face sheet; (iii) four mattress side face sheets; (iv) an integral bottom face and evacuation sheet; (v) at least one top evacuation sheet that is configured to enclose a person lying above the top face sheet; (vi) securing structure configured to tighten the top evacuation sheet downward over the patient to secure the patient to the evacuation mattress; and (vii) manual transport structure configured for a care-giver to drag the evacuation mattress and secured patient along a horizontal surface.

In a further aspect, the present invention relates to method of manufacturing an integral evacuation mattress that includes such manufacturing steps as affixing a plurality of wheels to the bottom sheet, affixing the bottom sheet to the mattress interior, affixing mattress top and side face sheets to the mattress interior, affixing the evacuation top sheet(s) to the bottom sheet, affixing the securing cords/straps/hardware to the evacuation top sheet, and affixing the manual-transport cords/straps/webs to at least one of the bottom sheet and the top evacuation sheet. The affixing steps may comprise any one or more or any combination of welding, stitching, vacuforming, etc.

In yet another aspect, the present invention relates to a method for using an evacuation mattress, comprising: (i) pulling an evacuation top sheet over a patient lying on bedding material on the evacuation mattress; (ii) manipulating securing structure on the evacuation mattress to tighten down the top evacuation sheet to secure the patient to the top of the mattress; (iii) moving the secured patient and the evacuation mattress to the floor; and (iv) using manual-transport structure, drag the secured patient and the evacuation mattress along the floor such that the bottom sheet of the mattress, which is adjacent a mattress interior, contacts the floor.

BRIEF DESCRIPTION OF THE DRAWINGS

Certain embodiments of the invention will now be described in detail with reference to the annexed drawings, in which.

DETAILED DESCRIPTION OF THE DISCLOSED EMBODIMENTS

In accordance with the preferred embodiments of the present invention, the evacuation structures (including, for example sheets) are made integral with the mattress, so that each hospital mattress comprises a single, one-piece evacuation mattress known to have proper evacuation structure permanently installed therein. In particular, each evacuation mattress will have an integral: mattress, a bottom evacuation sheet, a top evacuation sheet (which may comprise a head top evacuation sheet and a foot top evacuation sheet), as well as the traditional mattress-covering top and side face sheets. Thus, the bottom evacuation sheet will form a portion of the mattress itself, and will perform the two functions of mattress face bottom and evacuation sheet bottom. The top and bottom evacuation sheets are preferably made of an appropriate material (for example, a tough, wear-resistant, low-friction, plastic material such as Mylar™, to be described more fully below). A single care-giver may thus easily deploy the top evacuation sheet(s) over the patient, tighten evacuation cords and/or straps to secure the patient to the evacuation mattress, move the patient to the floor, and then drag the evacuation mattress and patient from the hospital to an evacuation center. Preferably, to aid in transport from the hospital, wheels may be provided. In one embodiment, in between the bottom sheet and the mattress interior (foam, springs, webs, combinations, etc.) one or more spine or stiffening boards is/are disposed in the width-direction of the mattress, with multiple cylindrically-shaped wheels mounted therein and disposed to protrude through the bottom sheet. Also preferably, the bottom sheet and/or the top evacuation sheet(s) will have appropriate straps (to be described below) so that one care-giver can deploy the top evacuation sheet and then transport the patent and mattress from the hospital.

Figure 1:
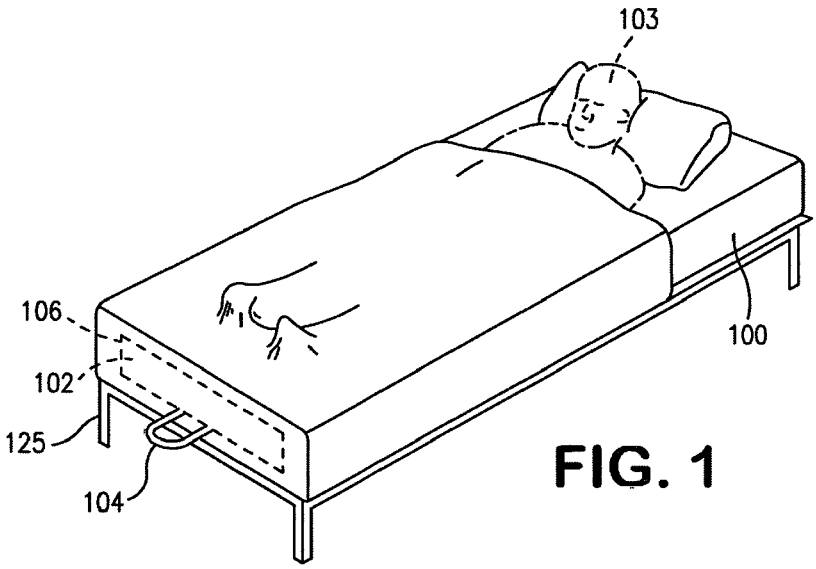
FIGS. 1, 2, and 3 are sequential perspective views showing deployment of an evacuation mattress according to the present invention.

Referring to FIG. 1 a person 103 lies on an evacuation mattress 100 on a bed frame 125. Visible at the foot end of the evacuation mattress 100 is a handle 104 attached to the foot top evacuation sheet (not shown), which is disposed in pouch 102 at an end of the mattress, ready for deployment. A handle similar to the handle 104, but attached to the head top sheet, extends from a pouch similar to pouch 102 (not shown) at the head end of the mattress 100. The mattress has traditional top and side covering or sheets, made of an appropriate plastic or rubberized material, such as laminated vinyl, vinyl, or plastic.

Figure 2:
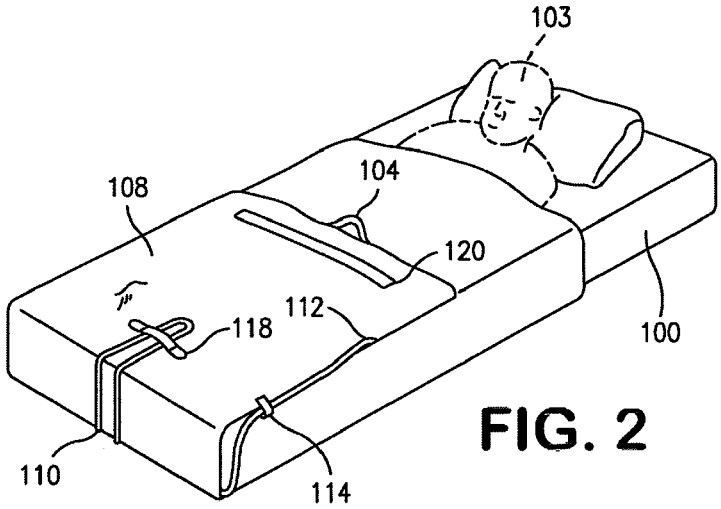

FIG. 2 shows that by pulling the handle 104, a top foot evacuation sheet (or sheet) 108 is drawn out from its place of storage inside pouch 102 at the end of the mattress 100. The top foot evacuation sheet 108 may one or more sheets, webbing, sheaths, or any other suitable material for sheeting and securing the person 103 to the mattress 100. A further handle 110, which is preferably a cord, may be drawn out and releasably held against the top foot sheet 108 by a loop 118. The "cords" and "strands" referred to herein are preferably prestretched sailing rope 3/16 of an inch in diameter. Each end of the cord 110 is fastened to an edge of the top foot sheet 108 by stitching at an edge point (as well as on the other, unseen, side) 112 and runs through loops 114 along the edges of the top foot evacuation sheet 108. (The routing of the cord 110 between the head and foot ends of the mattress 100 and the longitudinal lower edges thereof, below the edge point 112, will be described in detail below in conjunction with FIGS. 5 through 15.) One end of the loop 118 is sewn to the top foot evacuation sheet 108 and the other end is releasably fastenable by complimentary hook and loop fastening material, such as VELCRO™, to enclose and retain the cord 110 when the cord 110 is drawn out with the top foot sheet 108.

By pulling the top foot evacuation sheet 108 over the person 103 from the foot of the mattress 100, towards the opposite (head) end of the mattress 100, the cord 110 and top foot sheet 108 are disposed to facilitate securely enclosing the person 103 between the top foot sheet 108 and the mattress 100.

Figure 3:
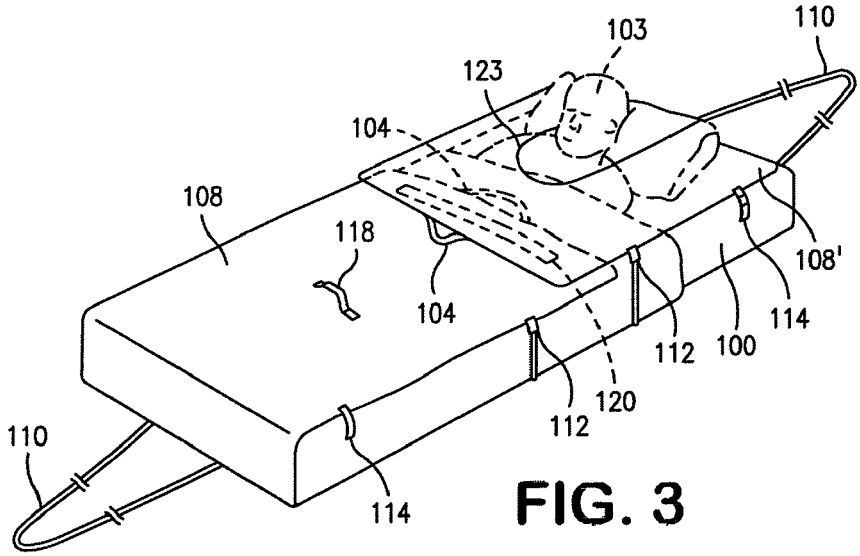
Figure 4:
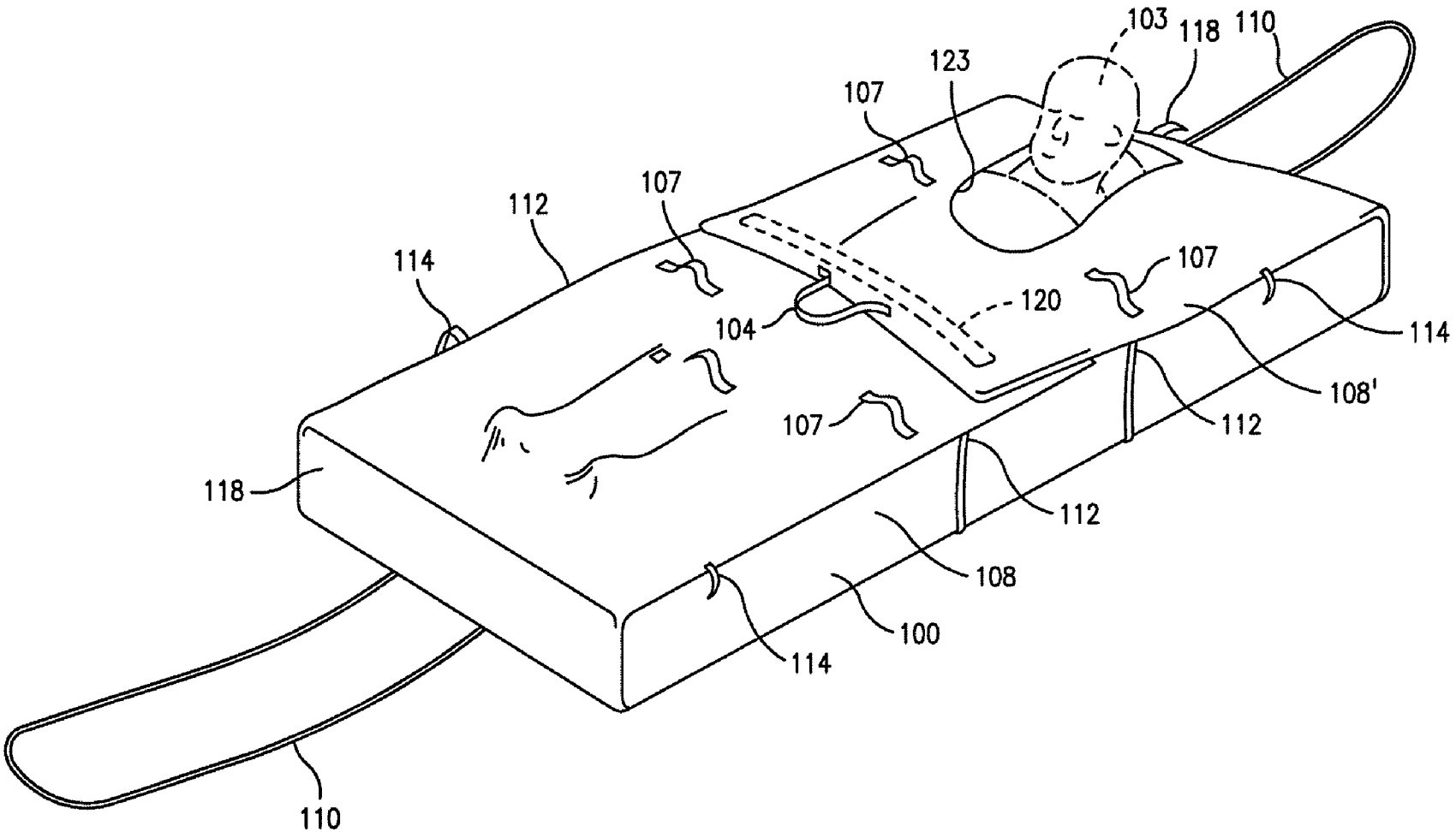
FIG. 4 is a perspective view of a variation of the evacuation mattress shown in FIG. 3, fully deployed and in use.

Referring to FIGS. 3 and 4, the top head evacuation sheet 108' at the head end of the mattress 100 includes an opening 123 for the head of the person 103. The top evacuation sheets 108 and 108' preferably are made of a flexible, high-tensile strength, sheet material, preferably including a heat reflective material such as metallic coated plastic film, such as MYLAR™. Other suitable materials may be used, such as nylon, Goretex™, rubberized cloth, cloth, etc., or any suitable combination of such materials. It is also preferred that each top evacuation sheet 108 and 108' be longer than half the length of the mattress 100. In use, the top evacuation sheets 108 and 108' are extended toward the head and foot ends of the mattress 100, respectively, and they preferably overlap. The top evacuation sheets are preferably fastened to one another, suitably by strips 120, with such strips made from complimentary hook and loop fastening material, such as VELCRO™ strips. By pulling on the cords 110, the long edges of the top evacuation sheets 108 and 108' are drawn down towards the lower edge of the mattress 100, securely enclosing the person 103 between the top evacuation sheets 108 and 108' and the mattress 100. Enclosure of the person 103 by the top evacuation sheets 108 and 108' secures the person 103 onto the mattress 100.

Referring to the embodiment shown in FIG. 4, each top evacuation sheet 108 and 108' includes handles 107 on its upper surface. Such further handles 107 are of use in lifting the mattress and person 103 from a bed to a floor, preferably by a single care-giver. Thereafter, the mattress and person 103 may be pulled along the floor using either cord 110, again preferably by a single care-giver.

Figure 5:
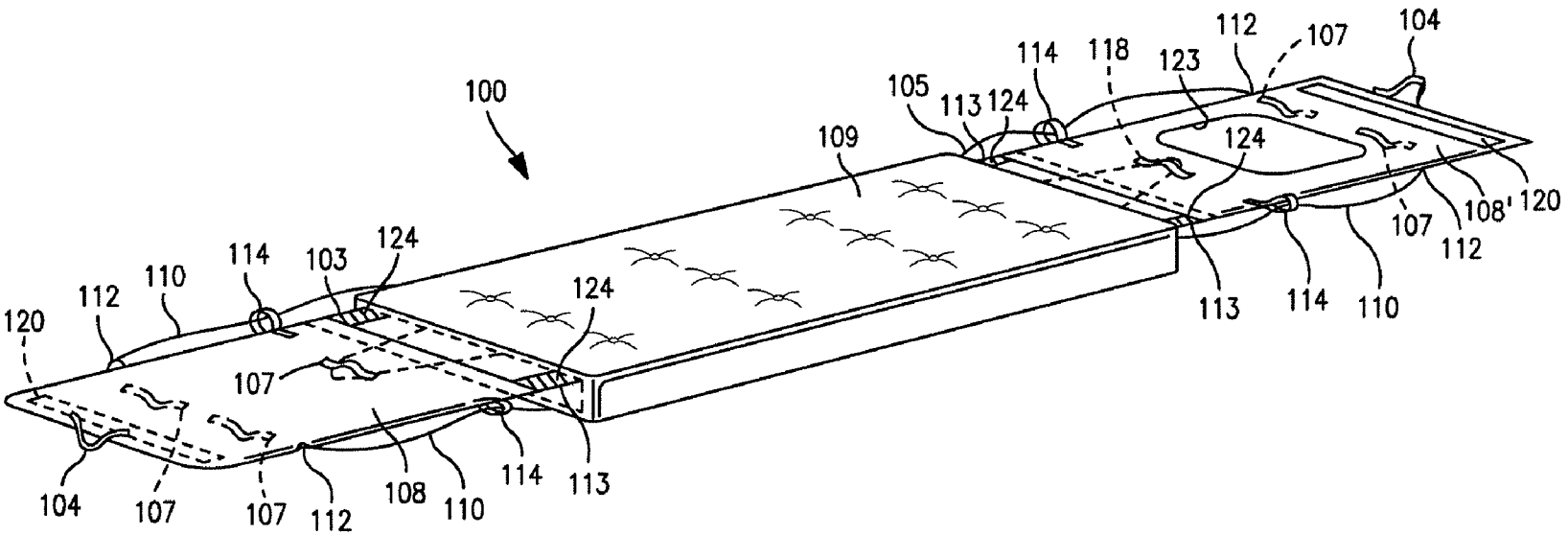
FIG. 5 is an exploded perspective view of the evacuation mattress shown in FIG. 4.
Figure 6:
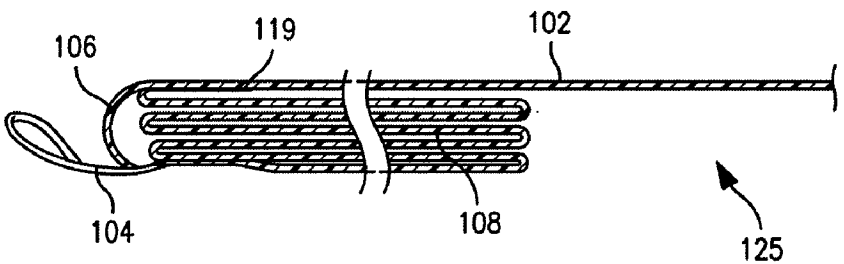
FIG. 6 is a cross sectional view of the folded top foot sheet 108 shown in FIG. 1, with the mattress omitted.

Referring to FIG. 5, the mattress 100 may include, at each end, a flap 106 (FIG. 1) for covering the respective top evacuation sheets 108 and 108' when they have been stored in pockets 102. The pockets referred to herein are not essential to the invention but may be used to keep the top evacuation sheets 108 and 108' out of the way of bed clothes. Top foot evacuation sheet 108 is attached to pouch 102 by stitching at 119. Velcro at 120 is preferred to keep the lid closed until the mattress is to be used. Alternatively, the top evacuation sheets 108 and 108' may be folded and stored beneath the respective foot and head portions of the mattress (e.g., 6-24 inches along the mattress longitudinal axis, from the mattress foot or head edge), between the mattress bottom sheet (to be discussed below) and respective second mattress foot and head bottom sheet portions affixed to the mattress bottom face (also to be discussed below). The top evacuation sheet(s) may also be attached to pouches attached to the vertical end faces of the mattress, or stored in small compartments within the mattress itself. Referring to FIG. 6, top foot evacuation sheet 108 is stored in an accordion-folded manner under the foot end of the mattress 100. For the purposes of clarity, the cord 110 has not been included in the Figure. The top head evacuation sheet 108' may be folded and stored in a similar manner. In both of these alternatives, it is preferred that the top foot and head evacuation sheets be permanently affixed to the bottom sheet (to be described below) to prevent material from entering between the bottom and top sheets during patient transport.

Figure 7:
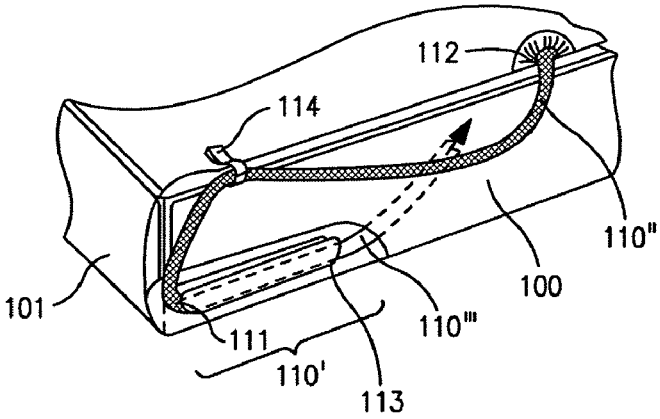
FIGS. 7, 8, and 9 are sequential, partial perspective views illustrating the securing of a sheet to a mattress.
Figure 8:
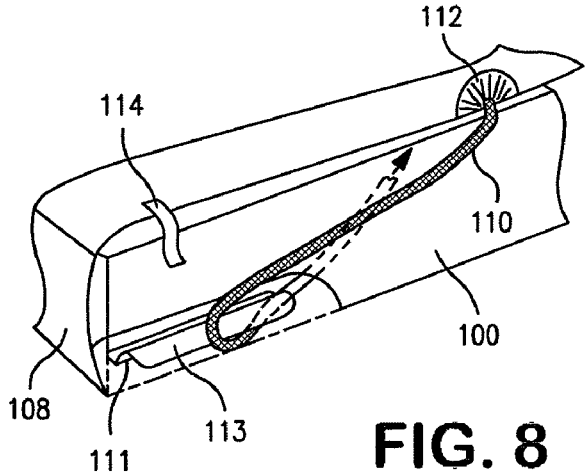
Figure 9:
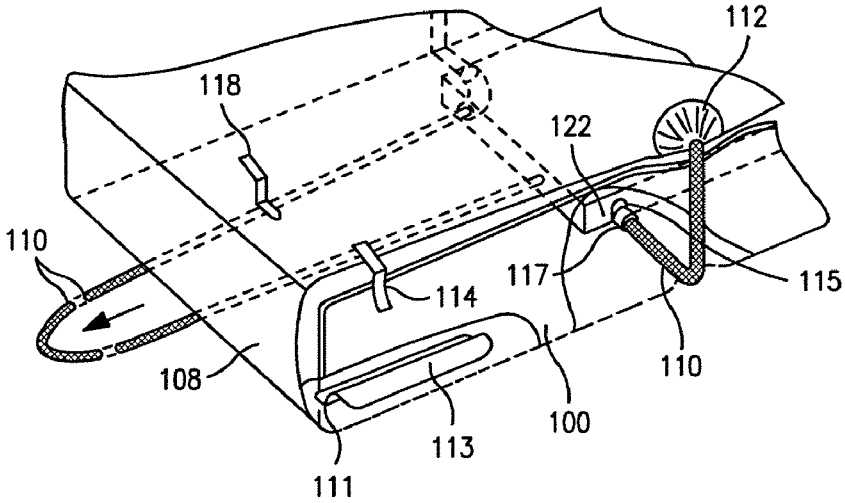

Referring to FIGS. 7 to 9, once the top evacuation sheets 108 and 108' are extended over the person 103 and joined to one another by the strips 120, the attachments 112 are approximately opposite transverse openings at the ends of the second grooves 115. By pulling the cords 110, away from the mattress 100 at each end of the mattress 100, each cord 110 passes along the grooves 115, drawing its associated top evacuation sheet 108 or 108' down toward bottom of mattress 100. That process will now be described in further detail with reference to FIGS. 9 to 11. Before the cord 110 is pulled, a portion 110' of it is in the groove 111, under sheet 113, below the mattress 100. Another portion 110" is along the side of the mattress 100 between the end of the mattress 100 (and groove 111) and the attachment 106. The remainder, 110'", is between the other end of the groove 111 and the spine 122 (not shown) and also extends into and through the spine 122. When the cord 110 is initially pulled the portion 110'" moves, in the plane of the spine 122 (not shown), in the direction shown by the arrow in the FIGS. 8 and 9.

Referring to FIG. 8, as the cord 110 is pulled, the cord 110 passes out of the groove 111, sheeting 113 and loop 114, and moves toward the opposite end of the mattress 100 and towards a position generally below the attachment 106. The force of pulling on the cord 110 detaches the end of the loop 114 having complimentary hook and loop fastening material, such as VELCRO™, from the sheet 108. Referring to FIG. 9, in the final state of securing the top evacuation sheet 108 over the mattress 100, the cord 110 extends from attachment 106 on top sheet 108, passes into the mattress 100 and through the spine 122 (along guide grooves 115 in the spine 122) and exits from the end of the mattress 100.

Figure 10:
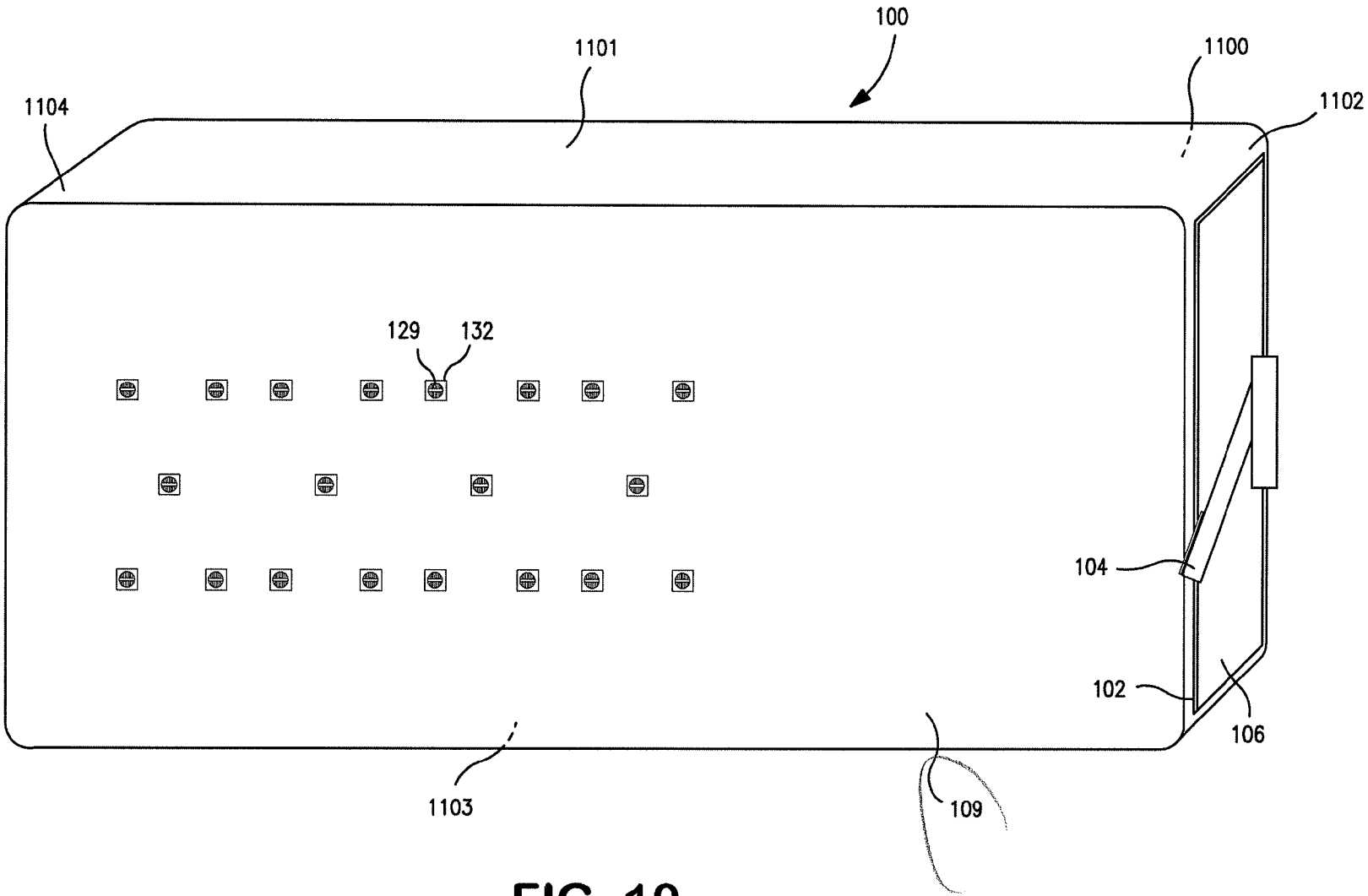
FIGS. 10 and 11 are, respectively, plan and side views of a sled useful for rolling the embodiments shown in FIGS. 1 to 4.
Figure 11:
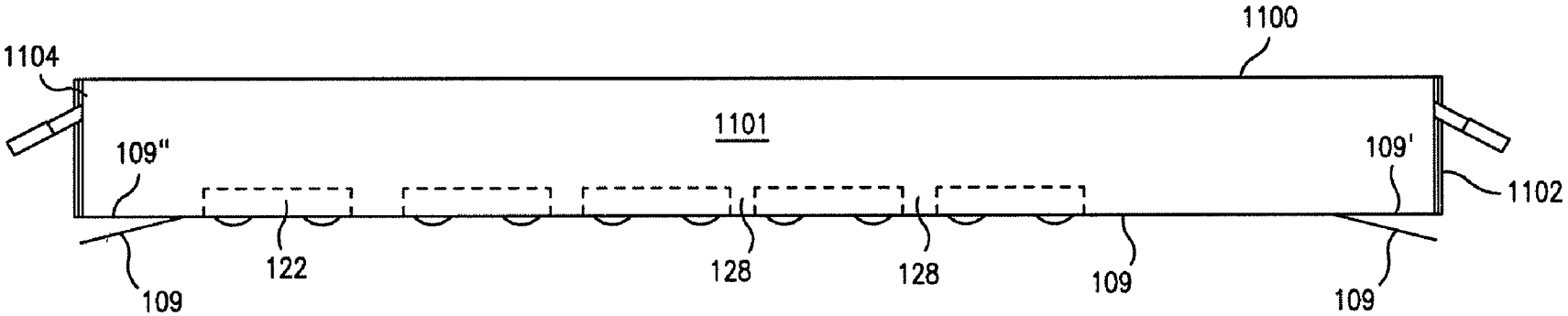
Figure 12:
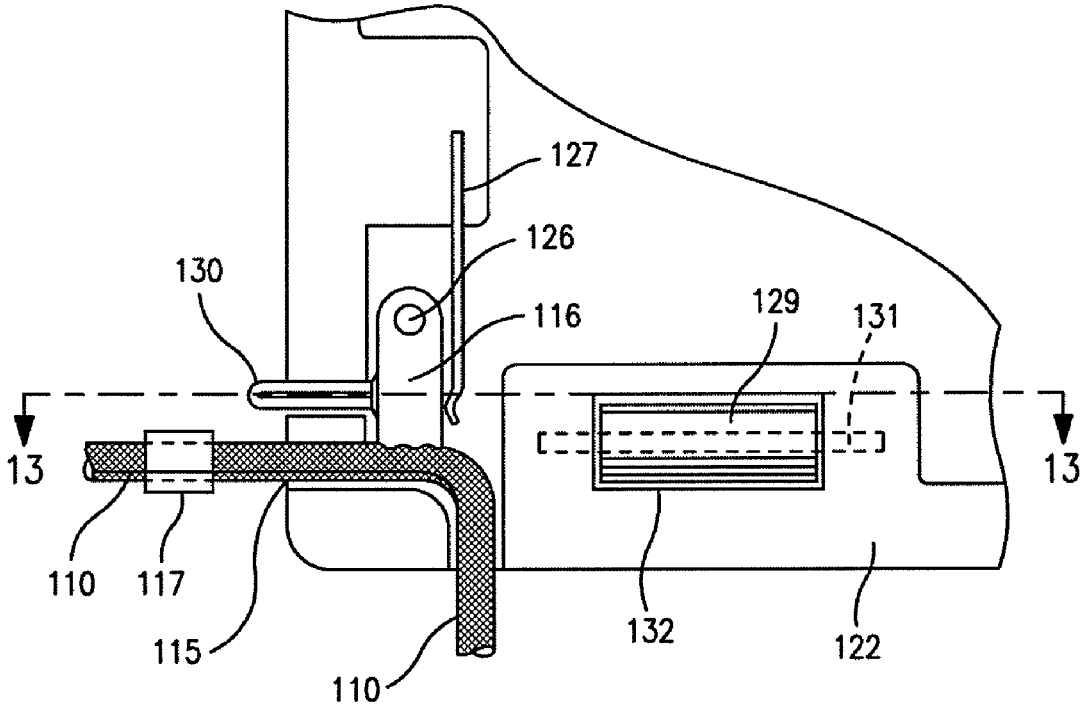
FIGS. 12 and 13 are views of the detail of the wheel assemblies depicted in FIGS. 10 and 11.

Referring to FIGS. 10 to 12, the bottom sheet 109 forms the bottom of the mattress 100 and preferably comprises the same material(s) as the top evacuation sheets 108 and 108'. Preferred materials for the bottom sheet 109 are laminated vinyl from about 1/32 inch to 5/32 inch thick, preferably from about 1/16 inch to 2/16 inch thick, and most preferably about 3/32 inch thick. Thus, the bottom sheet 109 is preferably a thick plastic material reinforced with cloth or fiber and configured to resist damage when the evacuation mattress is dragged along a horizontal surface. The bottom sheet 109 forms both the mattress bottom face sheet and the bottom evacuation sheet. Mattress 100 also has a mattress top face sheet 1100, and mattress side face sheets 1101, 1102, 1103, and 1104. These face sheets also form parts of the mattress itself. Again, these sheets preferably comprise the same material(s) as the top evacuation sheets 108 and 108'. In use, the mattress top and side face sheets 1100 and 1101, 1102, 1103, and 1104 are typically covered with linens, blankets, etc., for patient comfort and ease. The mattress sheets 109, 1100 and 1101, 1102, 1103, and 1104 may be joined together by welding, stitching, or as a single sheet of material, or any combination thereof. These face sheets, together with the dual-function bottom sheet, form the outer mattress cover which encompasses the mattress interior (foam, springs, webbing, etc.). The mattress interior material(s) may be affixed to the above-listed face sheets by welding, gluing, stitching, vacuforming, or any suitable method of forming a mattress. The integral evacuation mattress can be manufactured by the steps of affixing a plurality of wheels to the bottom sheet, affixing the bottom sheet to the mattress interior, affixing mattress top and side face sheets to the mattress interior, affixing the evacuation top sheet(s) to the bottom sheet, affixing the securing cords/straps/hardware to the evacuation top sheet, and affixing the manual-transport cords/straps/webs to at least one of the bottom sheet and the top evacuation sheet. The affixing steps may comprise any one or more or any combination of welding, stitching, vacuforming, etc. As discussed above, where the top evacuation sheet(s) 108 are stored beneath the mattress, the bottom sheet 109 preferably includes second layers 109' and 109" so that when the top sheet(s) 108 are deployed, a suitable sheet layer protects the mattress interior at those locations. The top evacuation sheet(s) 108 may then be folded and stored in the spaces between the bottom sheet 109 and the second sheet layers 109' and 109".

Figure 13:
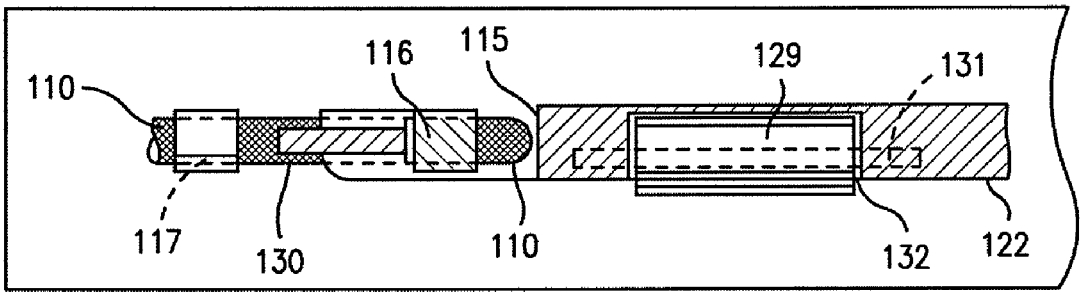

As best seen in FIG. 11, within the mattress and above the bottom sheet 109 there are preferably one or more spine or stiffening boards 122. One or more of the boards 122 may segmented at 128 to facilitate its conforming to the shape of the mattress 100. Such boards typically run the width of the mattress 100, and may have a length of from 6-24 inches in the longitudinal direction of the mattress. These boards 122 provide additional support for the patient during transport, and form a stable platform for the wheels 129 to be described below. Each board 122 is preferably made of a rigid material such as injection molded plastic, wood, fiberboard, etc. Each board 122 may be encased in the mattress interior material (such as foam) or be carried in envelopes made of the same material as the bottom sheet 109. Each spine 122 preferably has in its lower surface, wheels, runners, or bumps for ease of moving the mattress 100 along a surface, such as a bed frame, a floor, stairs, concrete driveways, soil, etc. In the embodiment shown in FIGS. 12 and 13, a wheel-axle assembly is mounted in openings 132 in the lower portion of the mattress 100, such that a wheel 129 in such an assembly will roll on the surface below the mattress 100. A wheel-axle assembly comprises a wheel 129 having cylindrical cross-section and a rotational axis parallel to the lower surface of the spine 122. Each wheel-axle assembly also comprises an axle attached to the wheel 129 and mounted in the opening 132. Preferably, the wheels 129 are constructed of nylon, but may comprise any suitable plastic or metal.

Another aspect of the invention is that the bottom sheet 109 may have one or more areas of high friction material, to slow the mattress 100 in its travels down stairways and inclines. These areas of high friction material may comprise rubberized plastics or cloth, preferably disposed at the foot and head end of bottom sheet 109.

Referring again to FIGS. 12 and 13, the spine 122 preferably includes a cleat or ratchet 116 engageable with the cord 110 to retain the tautness of the top sheet 108 against the mattress 100 and person 103. The cleat or ratchet 116 is engageable with the cord 110 by plugs or knots 117, extending from the cord 110. The plugs or knots 117 inhibit movement of the cord 110 into the guide grooves 115. The cord 110 can be partly withdrawn from the spine 122 while the cleat or ratchet 116 is disengaged from the cord 110. Such disengagement is achieved by pressing release pin 130 against ratchet 116 such that ratchet 116 pivots about post 126, subject to restraint from spring 127, so that cleat 116 rotates away from cord 110. The cord 110 can then be pulled back along the groove 115 while cleat 116 is disengaged from the cord 110.

Figure 14:
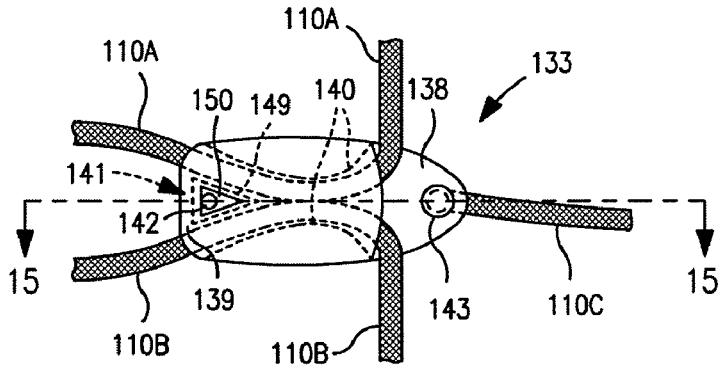
FIGS. 14 and 15 detailed views of a cord-lock structure.
Figure 15:
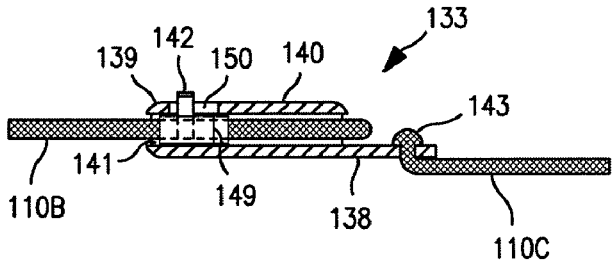

Referring to FIGS. 14 and 15, in another preferred embodiment, the guide 133 comprises a base 138 to which the cord 110C is attached at one end at 143. A sheet 139 extends over most of the remainder of the base 138. Within the sheet 139 are channel walls 140 running along the length of the guide 133. The cords 110A and 110B enter the guide 133, near the attachment 143, via the gap between the channel walls 140. The cords 110A and 110B tend not to tangle but rather to stay next to the channel walls 140 as a result of (i) small clearance between the bottom of the sheet 139 and the top of the cords 110A and 110B, (ii) the preferred converging actuate perimeters of the channel walls 140, and (iii) a wedge-shaped cleat 141. The cleat 141 narrows in the direction of travel of the guide 133 i.e., in the direction the guide 133 travels along the edge of the mattress 100 as the sheet 108 is being secured. The cleat 141 preferably has teeth 149 to bite the cords 110A and 110B if force is applied to the guide 133 that would tend to direct the guide 133 back along cords 110A and 110B to the starting position of the guide 133. However, it is also preferred that the cleat 141 is positionable in an opening 150 in the sheet 139. Preferably, the opening 150 is near the trailing end of the guide 133. A pin 142 extends from the cleat 141 through the opening 150. By grasping the pin 142 and pulling the cleat 141 in the direction opposite to the ordinary direction of travel of the guide 133 the teeth 149 can be sufficiently distanced from the cords 110A and 110B to allow the guide 133 to be drawn back along the cords 110A and 110B, restretching the cord 110C, and allowing for the evacuee to exit the mattress and for the mattress to be reused.

Figure 16:
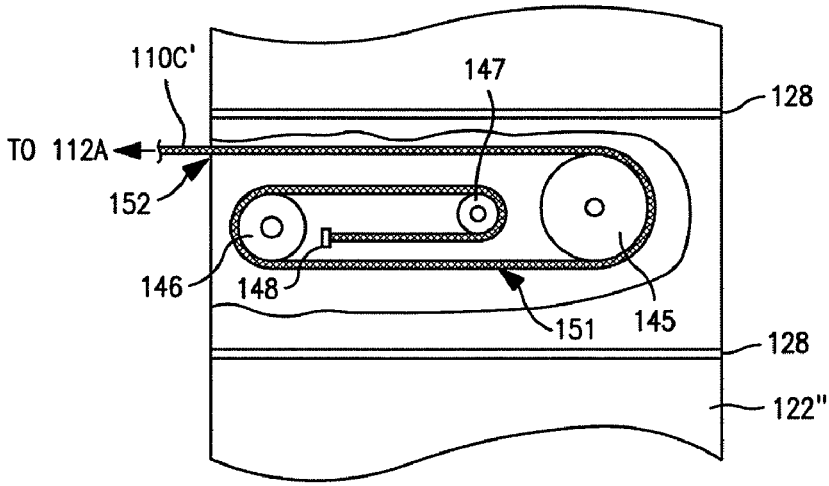
FIG. 16 is a plan view of the detail of connecting the cords to the spine board(s)

In a still further embodiment, the pre-stretched cord of the first alternative embodiment runs through a spine. In this further embodiment, it is preferred that the pre-stretched cord not run the length of the spine. With transverse segmentations (such as 128 in FIG. 11) the cord would tend to force the spine to curve upwardly at its ends. Rather, as shown in FIG. 16 it is preferred that the elastic cord 110C' be stretched within a single segment of the spine 122". In this embodiment, the cord 110C' is fixedly attached to the spine 122" at anchorage 148 and extends along groove 151. From attachment 148 the cord 110C' extends to and bears first on pulley 147, then extends to and bears on pulley 146 and finally extends to and bears on pulley 145 before exiting from the spine 122" at 152. The cord 110C' then extends to attachment 112A on top sheet 108. The cord 110C' is kept stretched, preferably by being secured by a latch (not shown), which is opened by drawing the tip sheet 108 out of the pocket 102.

In a further preferred embodiment, the top sheets 108 and 108' are drawn out of respective pouches 102 by pulling on handles 104 and 104' attached to the respective top evacuation sheets 108 and 108'. The configuration of the mattress before that occurs will now be described, with reference to FIG. 17.

Figure 17:
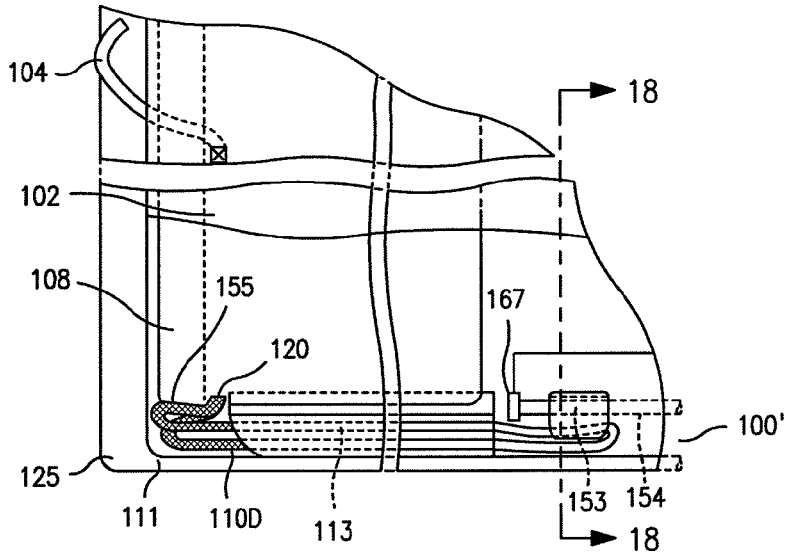
FIGS. 17 to 20 are perspective partly broken away views of the detail of folding the foot and head top sheets below the mattress.

Referring to FIG. 17, there is shown a mattress 100' including pouches 102 having lids 106, grooves 111, and groove sheetings 113, for use on a bed frame 125 as described above. The mattress 100' further comprises a lip 154 spanning a substantial length of each long edge of the mattress 100', beginning at the backs of the pockets 102. A cleat 153 slidably engages the lip 154 which preferably has a thickened portion 167 at each end to stop the cleat 153 from sliding off either end of the lip 154. A looped cord 110D extends through the cleat 153. The looped cord 110D passes through the cleat 153 and extends along the grooves 112, under the sheets 113 and is respectively attached to the top sheet 108 at connection points 106 and 155 inside the pockets 102.

Figure 18:
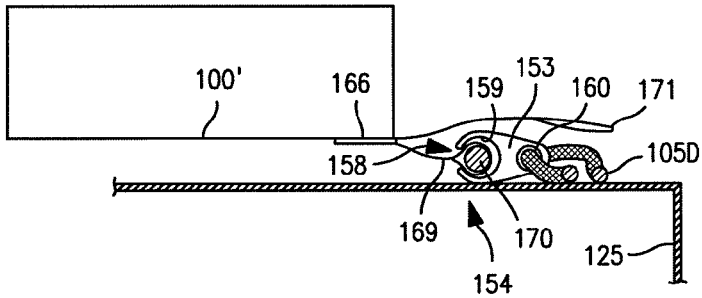
Figure 19:
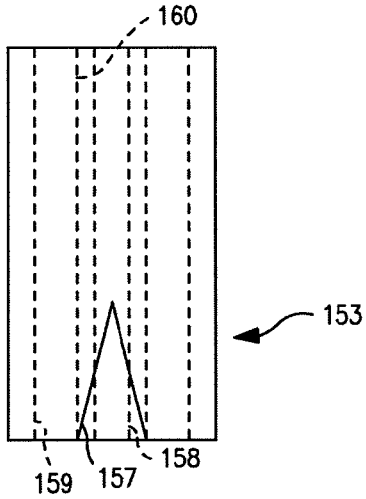
Figure 20:
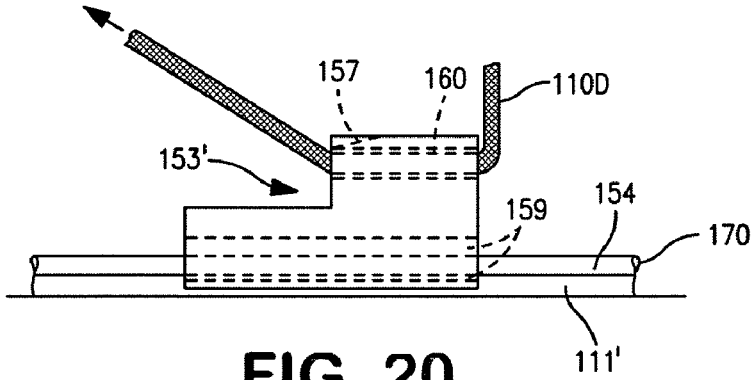

Referring to FIG. 18, lip 154 is formed by a cord 170 tightly enclosed in a hem by stitching 169 and attached to the edge of the mattress 100'. The lip 154 is parallel, and adjacent, to each long edge of the mattress 100'. Near the side edges of the back of each pocket 102 the lip 154 and the edge of the mattress 100' are sheeted by a flap 168 to keep the cleat 153 and lip 154 out of the way of bed clothes such as sheets and blankets. One edge of the flap 168 is secured to the mattress 100' by stitching 166 and the other edge has a hem 171. Referring also to FIG. 19, the cleat 153 is tubular and has a C-shaped transverse cross-section. Along the full length of its base an opening 158 extends. The opening 158 communicates along its length with a passage 159 which also runs the full length of the cleat 153. The passage 159 is substantially the shape as, but larger than, the lip 154. The cleat 153 and lip 154 are made of material that is sufficiently flexible to allow the lip 154 to be pushed through the opening 158 into the passage 159. Above the passage 159 and also extending the full length of the cleat 153 is a passage 160. The passage 160 has a large enough cross-section to allow the cord 110D to travel through it. At one end of the passage 160 a notch 157 extends from that end of the passage 160 towards the top of the middle of the cleat 153, as best shown in FIGS. 19 and 20. Referring to FIG. 20, the notch 157 narrows toward the middle of the top of the cleat 153. That narrowing provides a way to secure the cleat 153 to the cord 110D. By pulling upwardly on the portion of the cord 110D extending out of the wide end of the notch 157, the cord 110D is wedged in the notch 157. Care should be taken to balance the flexibility of the lip 154, cleat 153, and cord 110D, to ensure that the notch 157 can bite and hold the cord 110D without the cleat 153 popping off the lip 154. Referring to FIG. 20, the upper portion of a variant cleat 153' is not as long as the lower portion of the variant cleat 153'. As a result, the passage 160' in the cleat 153' is relatively shorter than the passage 160 in the cleat 153. As well, the distance between the narrow end of the notch 157 and the opposite end of the upper portion of the cleat 153' is shorter than the corresponding distance on the cleat 153. With the cleat 153' a larger force F can be applied to the cord 110D to make the notch 157 bite and hold the cord 110D with less likelihood of the cleat popping off the lip 154.

Figure 21:
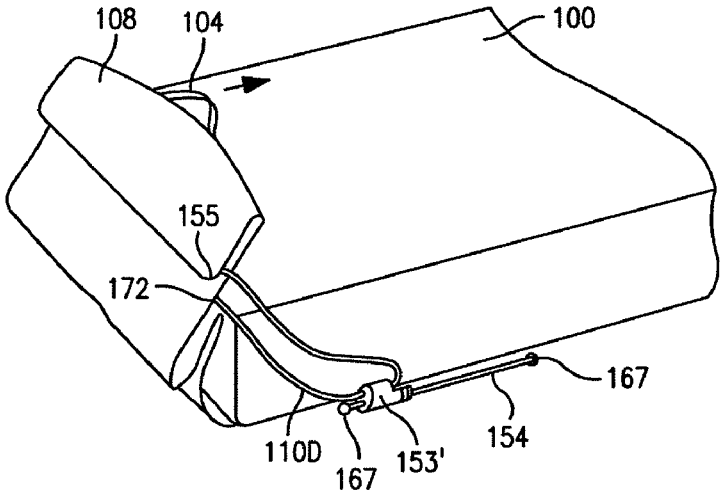
FIGS. 21 to 24 are sequential perspective views of a sequence of deploying the foot top sheet over top of the mattress, according to one embodiment of the present invention.
Figure 22:
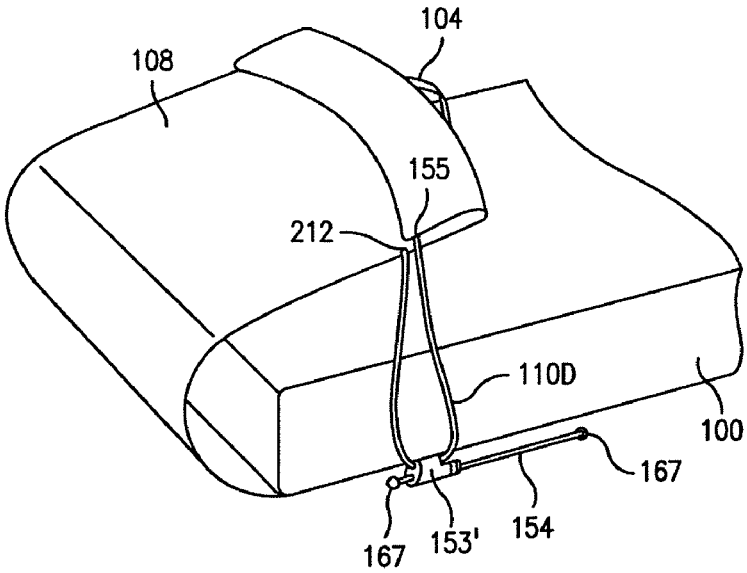

In FIGS. 21-24, the flap 168 is omitted for the purposes of clarity. Referring to FIG. 21, the handle 104 in this embodiment is not attached to the loose end of the top foot sheet 108, but rather is attached to the underside of it by sewing approximately 30 cm from that end. Approximately 30 cm of the top foot evacuation sheet 108 doubles back from the handle 104 over top of the rest of the top sheet 108. The cord 110D is attached, by sewing, to the top sheet 108 at points 112 and 155, 112 being approximately 60 cm from the loose end of the top sheet 108 and 155 being near that end. The portion of the cord 110D attached at 155 extends out of the notched end of the passage 160 and then doubles back to attach at 155. The portion of the cord 110D attached at 106 extends out of the other end of the passage 160, directly to attachment 112. Referring to FIG. 22, as the top foot sheet 108 is drawn out still further by pulling on handle 104, the cleat 153' moves toward the middle of the lower edge of the mattress 100, along the lip 154.

Figure 23:
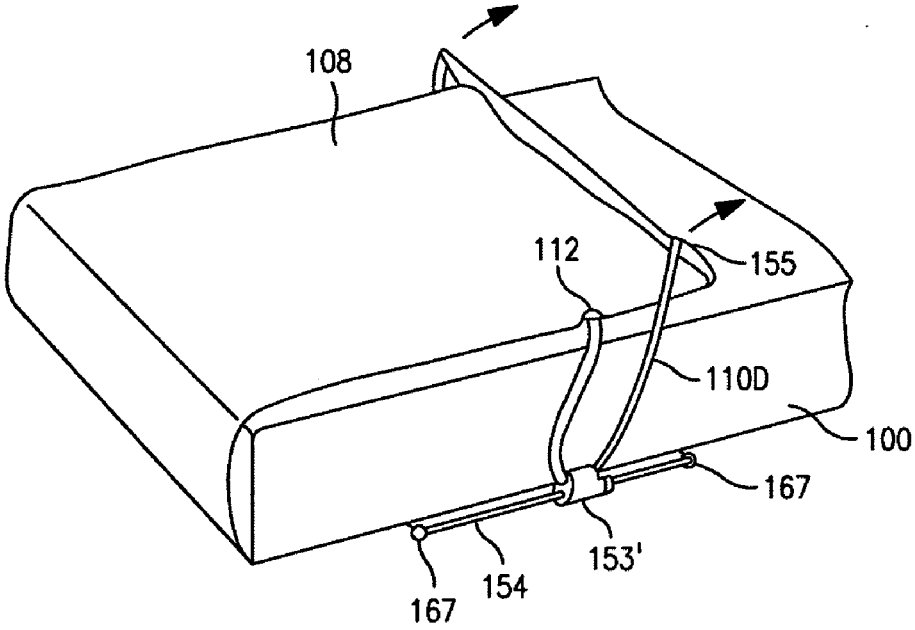

Referring to FIG. 23, once the top foot evacuation sheet 108 is fully drawn out of the pocket 102, the cleat 153' has traveled a substantial distance along the lip 154. The portion of the top sheet 108 folded over the remainder of the top sheet 108 is unfolded, by grasping the corners of the loose end of the top sheet 108, and the last 30 cm or so of the top sheet 108 are advanced in the direction of the arrows towards the opposite end of the mattress 100'.

Figure 24:
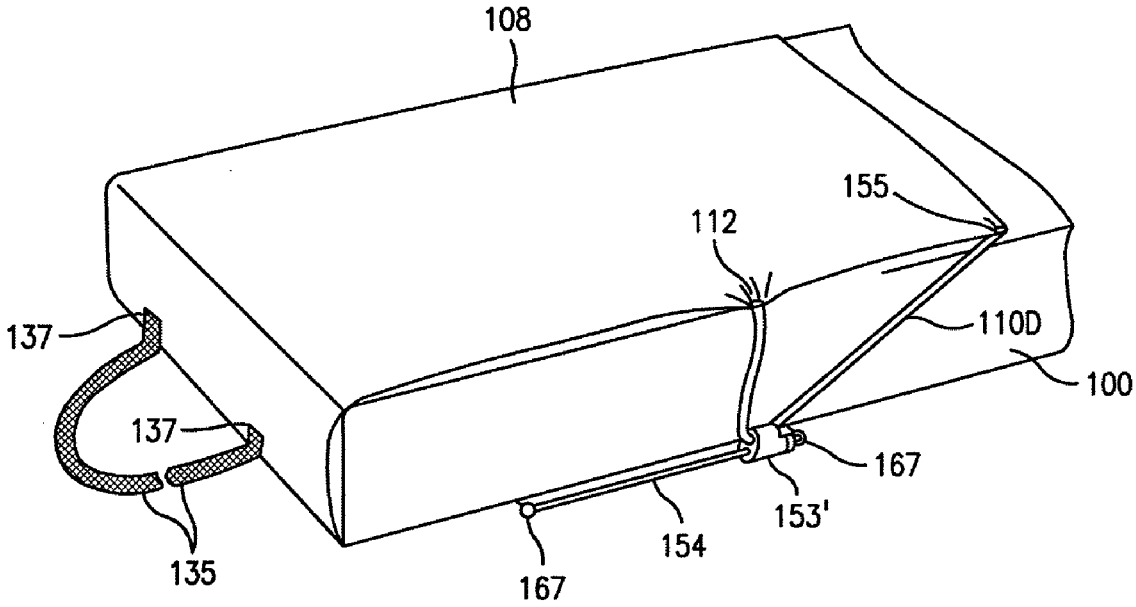

Referring to FIG. 24, the steps depicted in FIGS. 21, 22, and especially 23, have resulted in the cleat 153' advancing substantially the full length of the lip 154. In so doing the portion of the cord 110D between the attachment 155 and the cleat 153' has lengthened at the expense of the portion between the cleat 153' and the attachment 112, which has shortened. The top sheet 108 has been drawn towards the mattress 100'.

Figure 25:
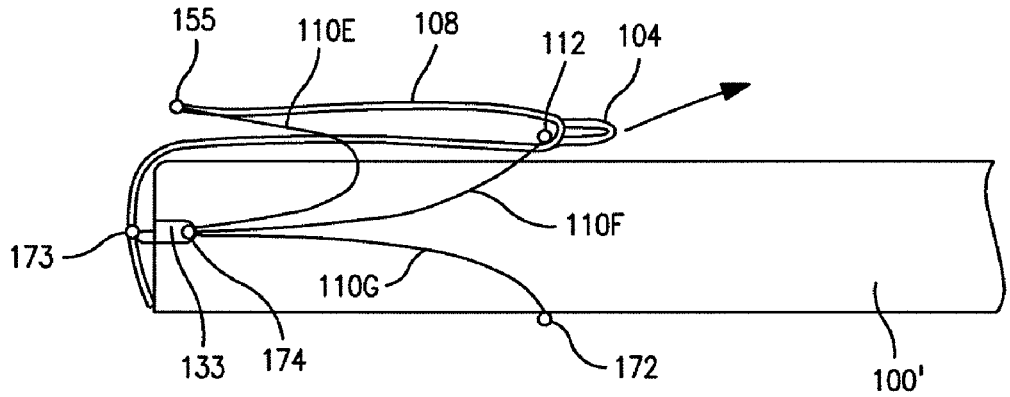
FIGS. 25 to 27 are sequential side views of another sequence of deploying the foot top sheet over top of the mattress, using the cord-handling structure(s)

A further aspect of the invention combines aspects of the embodiment depicted in FIGS. 21 to 24 with aspects of the embodiments depicted in FIGS. 14 to 21. This further aspect of the invention will now be described with reference to FIGS. 25 to 27. Referring to FIG. 25, the Figure shows the mattress once the top foot sheet 108 has begun to be drawn out from the mattress 100. The handle 104 on the top foot sheet 108 is attached to the underside of the top foot sheet 108, by sewing, approximately 30 cm from the free end of the top foot sheet 108. Approximately 30 cm of the top foot sheet 108 doubles back from the handle 104 over top of the rest of the top foot sheet 108. A cord 110F is attached to the edges of the top foot sheet 108, by sewing, at points 112 and 173, 173 being along the edge of the top sheet 108 approximately 60 cm from the free end of the top sheet 108 and 112 being approximately 30 cm from that end. A cord 110G is attached to the edge of mattress 100' by stitching 172 approximately 30 cm from the end of the mattress 100'. The cord 110G is also attached to the top sheet 108 by stitching 173. The cords 110F and 110G run through a guide 133 in a manner similar to the cords 110A and 110B depicted in FIGS. 20 and 21. A cord 110E is attached to the edge of the free end of the top sheet 108 by stitching 155 and to the leading end of the cleat 133 by clip 174.

Figure 26:
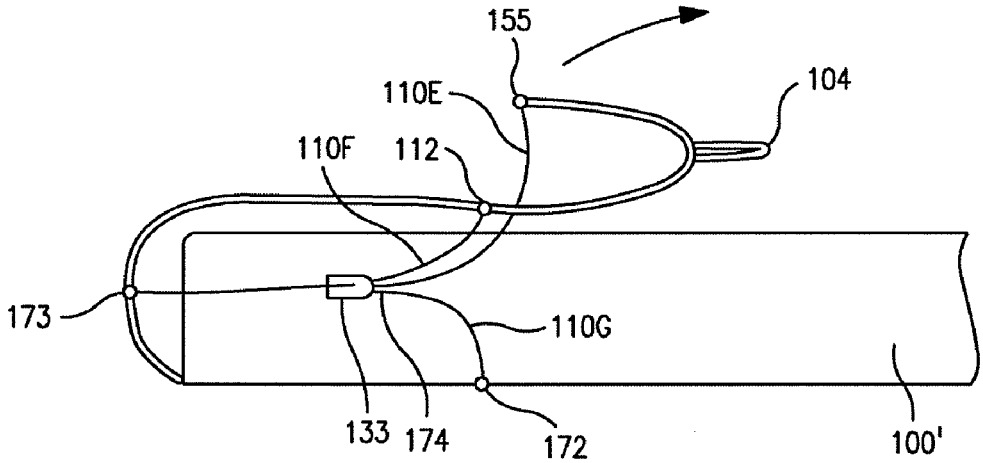
Figure 27:
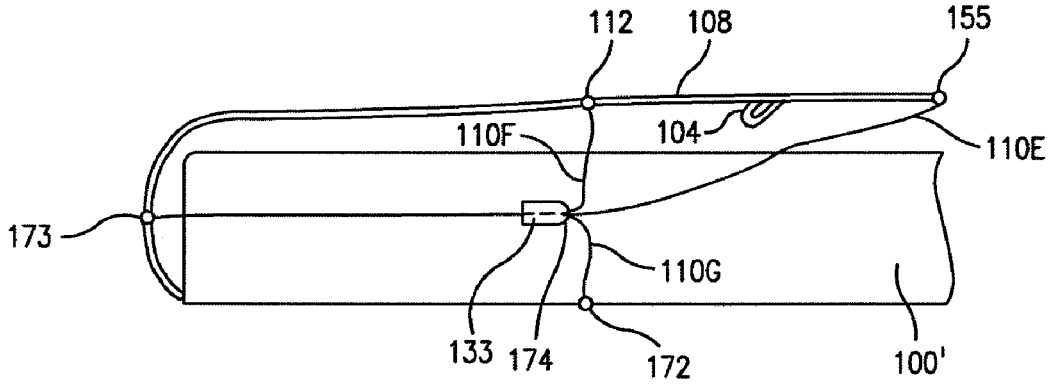

Referring to FIG. 26, as the top foot evacuation sheet 108 is drawn out still further by pulling on handle 104, the guide 133 moves in the same direction along the cords 110F and 110G. Referring to FIG. 27, once the top sheet 108 is fully drawn out, the folded portion of it is unfolded to fully tighten the cords 110E, 110F, and 110G, and the guide 133 has traveled a substantial distance along the cords 110F and 110G. In an alternative to the above-described preferred embodiments, the person 103 may be secured to the mattress 108 by a single top sheet 108 made of flexible material. The single top sheet 108 may be drawn out from side to side across the mattress 100 from the left side of the mattress 100 towards the right side of the mattress 100, or vice versa. The top sheet 108 may comprise a single sheet drawn from either the foot end of the mattress 100 or from the head end of mattress 100. To force such a single sheet 108 (or a plurality of sheets 108) against the mattress 100, at least one first clasp, at least one second clasp and at least one third clasp may be used. The first clasp secures the sheet 108 to the mattress 100 with the result that the sheet 108 is able to sheet a substantial portion of the person 103 and of the upper surface of the mattress 100. The second clasp is accordingly secured to the mattress 100. The third clasp is engageable with the second clasp to enclose the person 103 between the top sheet 108 and the mattress 100. The first clasp may be replaced by stitching and the second clasp may be a clip attached to the mattress 100 and specially adapted to engage the third clasp.

Figure 28:
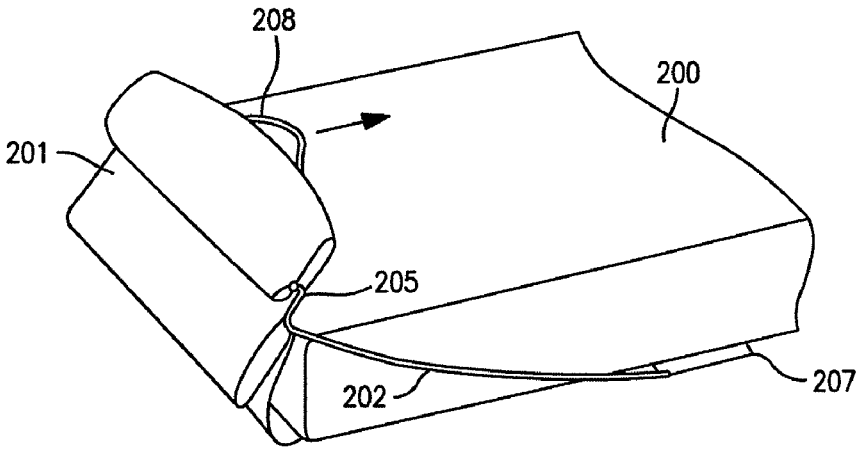
FIGS. 28 to 30 are sequential perspective views of a sequence of deploying the foot top sheet over top of the mattress, according to another embodiment of the present invention.
Figure 29:
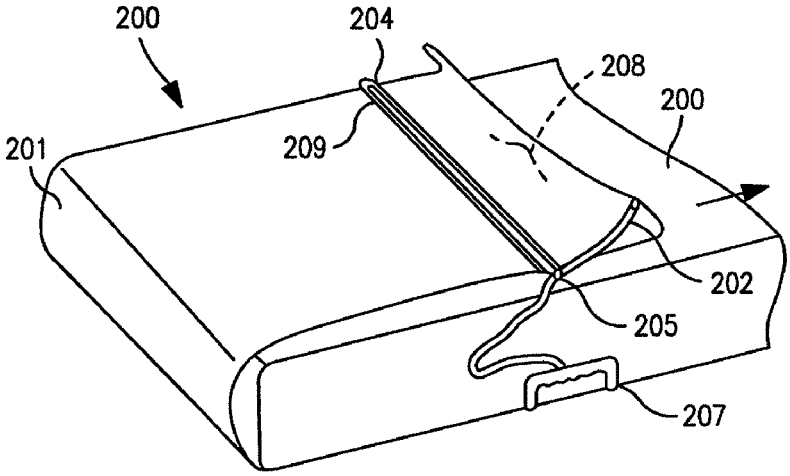
Figure 30:
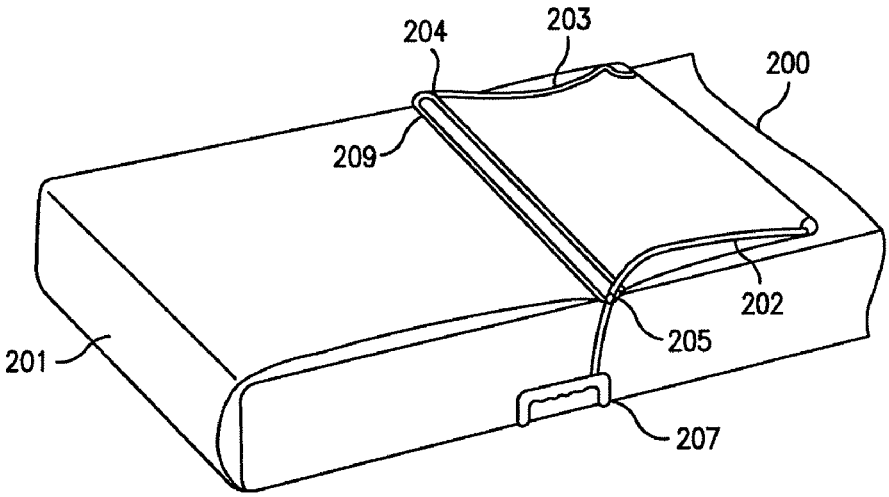

An improvement on the above described invention will now be described in detail with reference to FIGS. 28 to 36. Referring to FIG. 28, the improved mattress 200 supports the person 103 on the bed 125 as shown in FIG. 1. A portion of a flexible top foot evacuation sheet 201 is accordion-folded in a corresponding end of the mattress 200, underneath, at the end of, or on the top of the mattress 200. For brevity and clarity, this detailed description largely refers to one side and one end of the bed, i.e. single sheets, single cords, single cleats and single handles. It should be understood, however, that it is preferred that the mattress 200 be substantially symmetric. It will also be understood that except for a hole in the top head sheet, for the person's head, it is also preferred that the mattress 200 be symmetric at the foot- and head-ends, i.e. that it comprises either one sheet in the mattress emerging from the foot or head end of the mattress, or two sheets, similar to the evacuation sheet 201, emerging at the foot and head ends of the mattress 200, respectively, as described above. Similarly, it should be understood that there are preferably two handles on each long edge of the mattress. The mattress 200 further comprises two cords 202 and 203, two cleats 204 (not shown)

and 205, and two slotted handles 206 (not shown) and 207. In use, by grasping the handle 208, the accordion-folded portion of the sheet 201 is pulled towards, and then up and over the closest end of the mattress 200, such that the sheet 201 can then be pulled over the mattress 200 and over the person laying on that mattress 200. An aspect of the folding of the evacuation sheet 201 is that a last fold remains once the sheet 201 has been pulled over the person on the mattress 200 (FIG. 29). By then grasping the free end of the sheet 201 and pulling it towards the far end of the mattress 200, much of the length of each cord 202 and 203 passes through its respective cleat 204 and 205; the lower end of each cord 202 and 203 is movably secured to a respective handle 209 (not shown) and 210; and, as a result, the person is securely enclosed between the sheet 201 and the mattress 200 (FIG. 30). The handles 206 (not shown) and 207 can then be grasped to remove the mattress 200, with the person 103 secured to it, from the bed 125.

The evacuation sheet 201 is preferably made of vinyl reinforced with polyester; STAPH CHECK 20™ is such a material. The evacuation sheet 201 is approximately the size of the lower face of the mattress 200 with which it is to be used. (Of course, if a single sheet is used, then its length may be approximately twice that of the mattress.) Before being used to secure the patient, the sheet 201 may be disposed underneath approximately half of the lower face of the mattress 200. In this case, a second sheet of such material is preferably secured to the bottom face of the mattress 200 so that the mattress interior is not exposed to the environment. This secondary sheet, for example, may be welded or stitched to the sheet 201, or it may be integral therewith. A similar construction may be adopted for the head end of the mattress. The part of the sheet 201 that is below an end of that mattress 200 is preferably arranged in an accordion folded manner.

Figure 33:
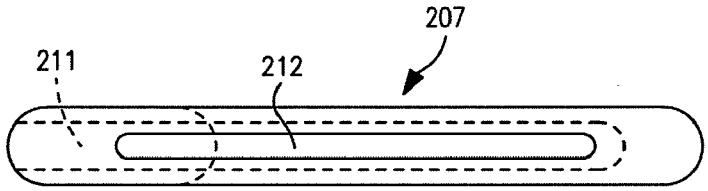
FIGS. 33 to 35 are views of the cord handle according to another embodiment of the present invention.
Figure 34:
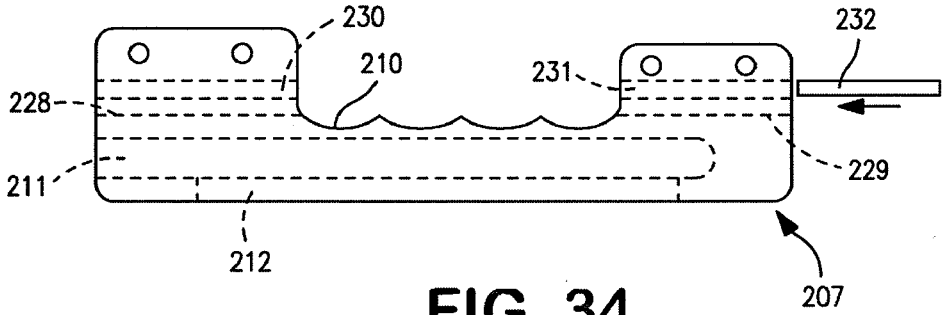
Figure 35:
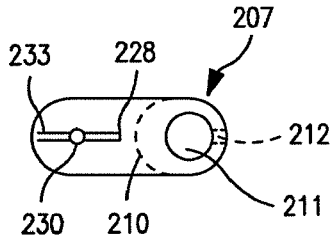
Figure 36:
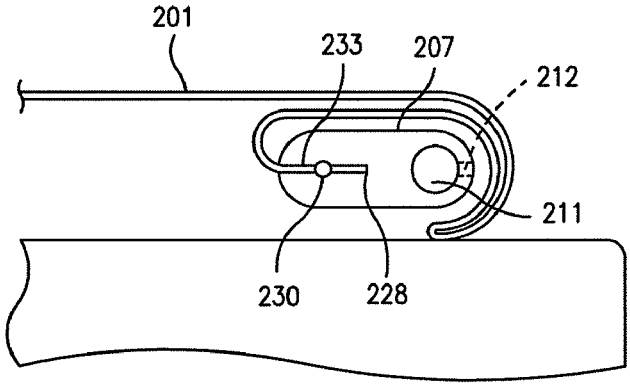
FIG. 36 is a side view of the handle of FIGS. 33 to 35 deployed with the mattress.

Pulling on the handle 208 tends to pull the edges of the evacuation sheet 201 away from the edges of the mattress 200. A batten 209 is attached to the cleats 204 and 205. The batten 209 is preferably a semi-rigid plastic strip approximately ⅛ of an inch thick and 1 and ½ inches wide. The batten 209 helps keep the sheet 201 at full width while the handle 208 is pulled. Referring to FIGS. 33 and 34, the slotted handle 207 is generally C-shaped, preferably made of injection molded plastic, approximately 7 inches long and includes hand grips 210. It is attached and parallel to a respective lower side of the sheet 201, such that when the mattress 200 is positioned for use, the handle 207 will be approximately 20 inches from the end of the mattress 200. A bore 211 in the slotted handle 207 is parallel to its longitudinal axis. The bore 211 extends completely to one end of the slotted handle 207 and the diameter of the bore 211 is greater than the diameter of the respective cord 202 with which it is to be used. An opening 212 extends from the base of the handle 207 to the bore 211. The width of the opening 212 is greater than the diameter of the cord 202 and less than the diameter of the bore 211. It is preferred that the handle 207 be attached to the sheet 201 a few inches from its edge so that, towards the end of pulling action of the cord 202, the handle 207 is pulled out from under the mattress 100 and the lower portion of the sheet 201. Attaching the handle 207 at that location keeps the handle under the sheet 201 and out of the way of bedding and of the bed 125 until the mattress 200 is being deployed. Setting the handle 207 back from the edge of the sheet 201 also facilitates the cord 202 clearing the corner of the mattress 200 as the sheet 201 is drawn out of the pouch 213.

The cleat 205 preferably comprises an injection molded plastic tube fixed to a respective side edge of the sheet 201, approximately 60 inches closer to the end of the sheet 201 than is the corresponding slotted handle 207, as measured along the sheet 201. A longitudinal opening in each cleat 205 runs the length thereof and is large enough for the cord 202, with which it is to be used, to move through the opening. The cleat may be of the same general shape as the cleat depicted in FIG. 14. Other suitable cleats may, of course, be used. The cord 202 is preferably ⅛ of an inch in diameter and made of high tensile strength material. An upper end of the cord 202 is stitched to a corresponding corner of the sheet 201. The other end of the cord 202 is then run through the longitudinal opening of the corresponding cleat 205, inserted into the opening 212 of the corresponding slotted handle 207 and run along and out the end of the bore 211 and secured against withdrawal from the opening 212 and bore 211. Suitably, withdrawal may be prevented by heating the inserted end until it is malleable, and then, while it is still malleable, thickening and flattening it so that its diameter is greater than the width of the slot 212 of that slotted handle 207 but not larger than the bore 211. Alternatively a nut can be secured to the inserted end of the cord 202 to prevent withdrawal. As a result of the above described structure the lower ends of the cords 202 and 203 are movably fixed in the bores 215 and 211 of respective slotted handles 206 and 207 near the bottom outside edges of the sheet 201 and mattress 200.

Figure 31:
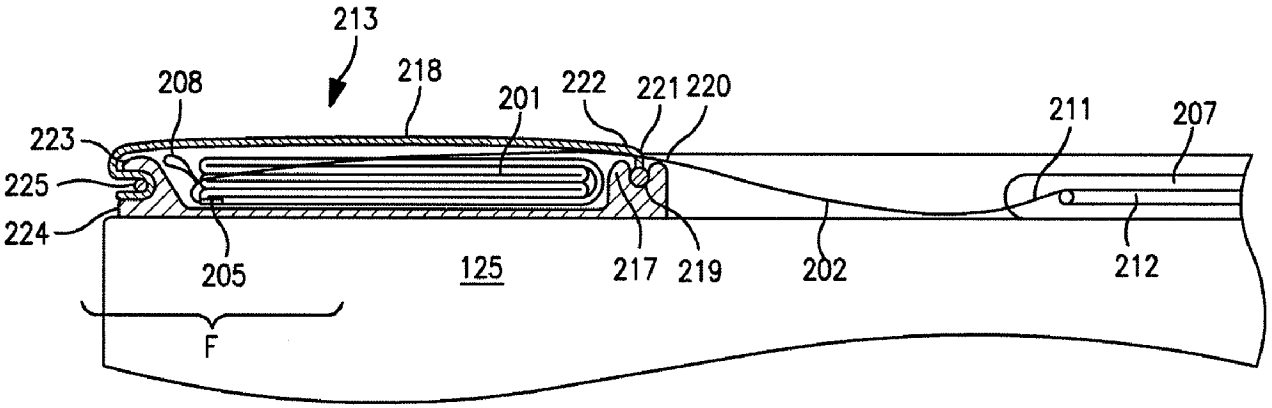
FIGS. 31 and 32 are side views of a particular embodiment of folding the top foot sheet between the mattress bottom surface and the bed frame.
Figure 32:
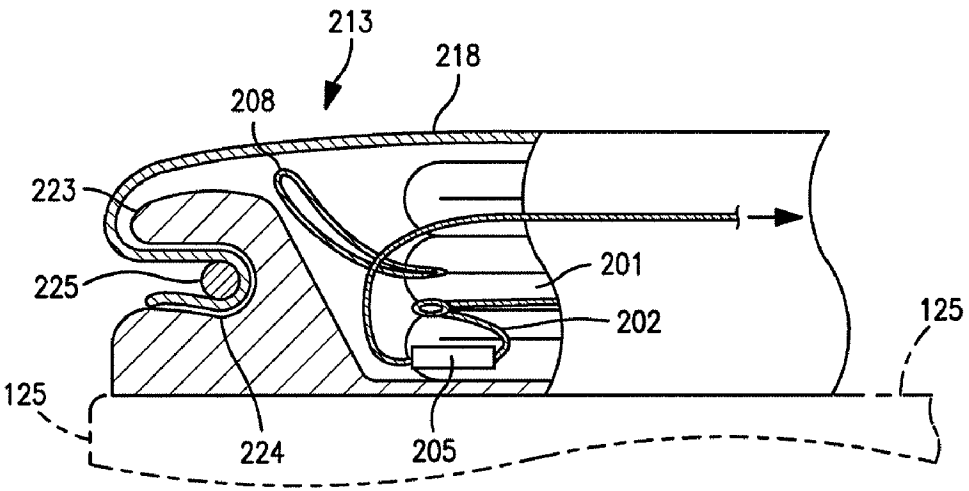

Referring to FIGS. 31 and 32, before use, the evacuation sheet 201 may be folded into a tray-like pouch 213. Preferably, the pouch 213 is, from top to bottom, approximately ½ inch thick and is made of injection molded plastic. Along an upper face 217 of the pouch 213, farthest from the end of the mattress 200, the sheet 201 passes between the top of the pouch 213 and the bottom face of a pouch sheet 218. In that region the pouch sheet 218 is sewn or welded or otherwise affixed to the top face of the sheet 201. Near the face 217, a groove 219 in the pouch 213 runs substantially the length of the face 217. An edge 220 of a strip 221 of STAPH CHECK 20™ is sewn or welded or otherwise affixed to the bottom face of the sheet 201, parallel to the groove 219. The strip 221 is then puckered to form a ridge of material that will snap into the groove 219. The other edge 222 of the strip 221 is then also sewn or welded or otherwise affixed to the bottom face of the sheet 201, taking care to preserve the required pucker of the strip 221. As an alternative to the strip 221, a cord made of squeezable material may be used to form the ridge of material that will snap into the groove 219.

Referring to FIG. 32, the front face 223 of the pouch 213 preferably includes a groove 224 running for substantially the length of the face 223. The sheet 218 preferably extends over the accordion-folded portion of the sheet 201, and over the face 223. The sheet 218 preferably overlaps enough of the front face 223 so that a 3/16 inch diameter rip cord 225 can be laid against the portion of the sheet 218 that extends over the groove 224 and, together with that portion of the sheet 218, snapped into the groove 224. The groove 224 preferably extends around the sides of the pocket 213. Snapping the puckered strip 221 into the groove 217, together with snapping the rip cord 225 and sheet 218 into the groove 224, keeps the accordion-folded portion of the sheet 201 largely sealed away from dirt and out of the way of bed clothes such as blankets and mattress sheets. The pouch 213 is preferably positioned close enough to the end of the mattress 200 so that the rip cord 225 can readily be grasped and pulled. The sheet 201 is preferably folded in the pouch 213 so that by pulling the rip cord 225, a looped cord handle 208 attached one fold back from the end of the sheet 201 will be exposed so that it can be grasped to pull the sheet 201 out of the pocket 213 and over the person who is on the mattress 200. The pouch 213 can then be snapped off of the puckered strip 221. Stability of the mattress 200 before use, and removal of the pouch 213 from the mattress 200 during use, are facilitated by the pouch 213 resting on the bed 125, but being attached to the bottom evacuation sheet 109, by means of sewing, welding, or complimentary hook and loop fastening material, such as VELCRO™.

The manner of attaching the handle 207 to the evacuation sheet 201 and stowing the attached handle 207 will now be described. In the region of handle 207 the width of the sheet 201 is preferably sufficient to allow the handle 207 to lay on the bed 125, and for the sheet 201 to overlap and sheet the handle 207. About an inch of the edge of the sheet 201 is preferably folded to produce a hem-like feature (not shown). The hem-like feature is then inserted into the slot-like openings 228 and 229 in the handle 207. The slots 228, 229 are widened over part of their extent, as at 230 and 231, to allow a dowel 232 to be inserted into the widened portion 231, between the closed end of the hem-like feature and the open end of the hem-like feature. Together with screws (not shown) screwed into holes 233 in the handle 207, the dowel 232 serves to secure the handle 207 to the sheet 201.

Figure 37:
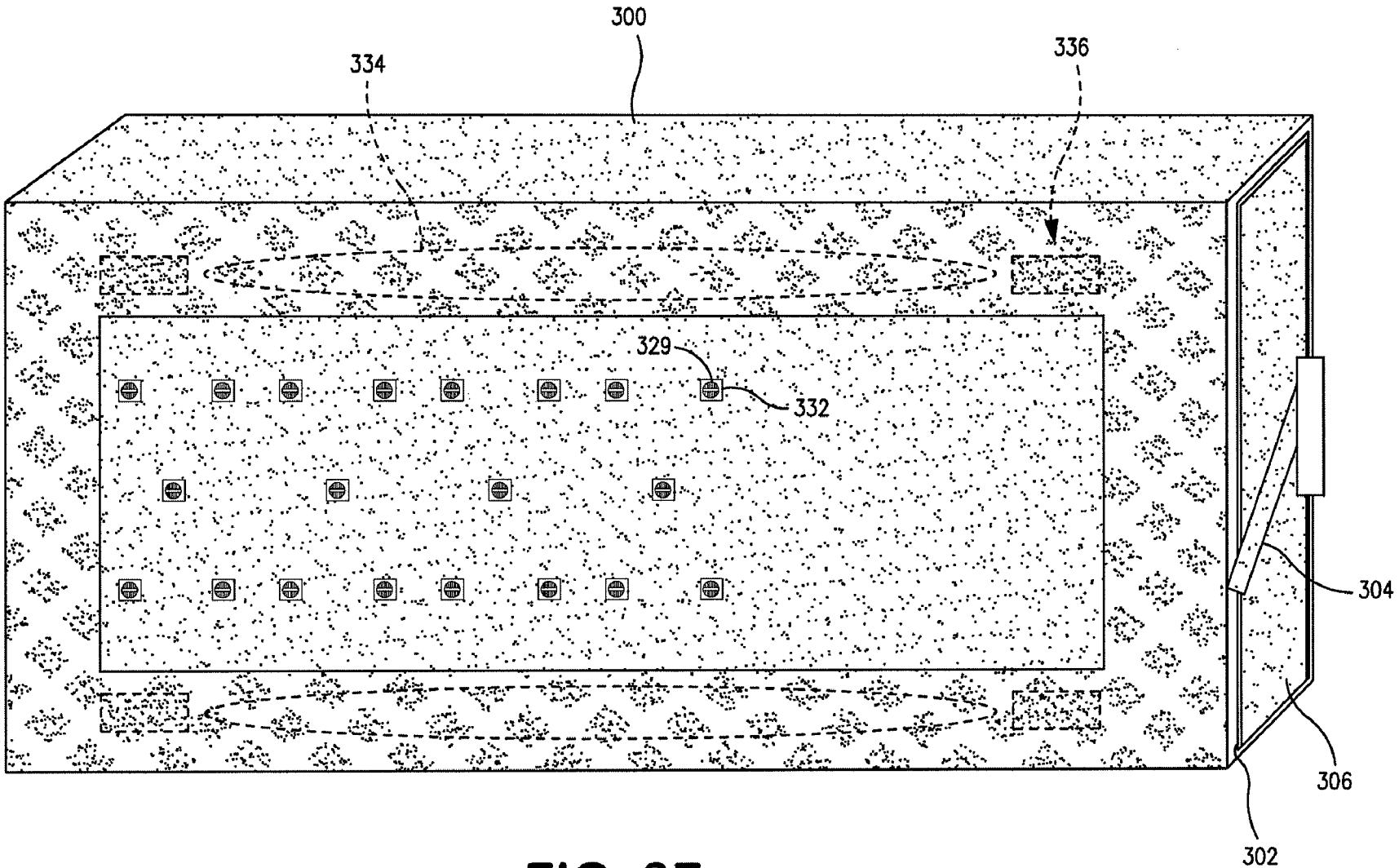
FIG. 37 is a perspective view of a floating embodiment of the present invention.

With reference to FIG. 37, another improved mattress 300 is shown. Mattress 300 is substantially similar to the mattress 100 discussed above, but has the added improvement of flotation devices (such as inflatable bladders, foam inserts, etc) 334 disposed substantially longitudinally along either side of the mattress 300, either inside the mattress interior, or on the top or bottom faces thereof (either underneath or on top of the top and bottom evacuation sheets 108 and 109). The flotation devices 334 are configured to support the mattress 300 as well as a person 103 (not shown) in water, such that at least the person's head will remain substantially above the surface of the water. Of course, it will be appreciated that any number of bladders 334 can be disposed in mattress 334 in suitable configuration(s) to achieve the desired floatation capabilities. Mattress 300 may further comprise one or more air canisters 336. Air canisters 336 are configured to contain a substantial amount of compressed air in order to fill the bladders 334 to reach the desired floatation capabilities for mattress 300. Again, it will be appreciated that there can be any number of air canisters 336 to contain the necessary volume of air required to fill the bladders 334.

A method of manufacturing an integral evacuation mattress includes such manufacturing steps as affixing a plurality of wheels to the bottom sheet, affixing the bottom sheet to the mattress interior, affixing mattress top and side face sheets to the mattress interior, affixing the evacuation top sheet(s) to the bottom sheet, affixing the securing cords/straps/hardware to the evacuation top sheet, and affixing the manual-transport cords/straps/webs to at least one of the bottom sheet and the top evacuation sheet. The affixing steps may comprise any one or more or any combination of welding, stitching, vacuforming, etc.

It should be understood that variations on the above-described improvement are possible. For example, the sheet 201 may be attached to the mattress 200, as may the handles 207, particularly if the mattress 200 does not include pouch 213.

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. It is therefore contemplated that the appended claims will sheet any such modifications or embodiments.

All publications, patents, and patent applications referred to herein are incorporated by reference in their entirety to the same extent as if each individual publication, patent or patent application was specifically and individually indicated to be incorporated by reference in its entirety.

What is claimed is:

1. An evacuation device comprising:

a top evacuation sheet configured to be deployed over a patient who is disposed on a mattress, while leaving the patient's head exposed;

a bottom evacuation sheet configured to be deployed underneath at least a portion of the mattress;

securing structure configured to secure the top evacuation sheet to the bottom evacuation sheet;

plural spinal boards coupled to said bottom evacuation sheet and configured to support the patient and mattress, said plural spinal boards being disposed substantially perpendicular to a longitudinal axis of the bottom evacuation sheet; and plural wheel-axle assemblies coupled to each spinal board and extending through holes in the bottom evacuation sheet, the plural wheel-axle assemblies being disposed in at least three columns with respect to the longitudinal axis of the bottom evacuation sheet.

2. The evacuation device according to claim 1, wherein the plural spinal boards are disposed more toward a head of the bottom evacuation sheet than a foot thereof.

3. The evacuation device according to claim 1, wherein the plural spinal boards comprise four spinal boards.

4. The evacuation device according to claim 3, wherein at least four wheel-axle assemblies are coupled to each spinal board.

5. The evacuation device according to claim 3, wherein at least five wheel-axle assemblies are coupled to each spinal board.

6. The evacuation device according to claim 5, wherein four of the at least five wheel-axle assemblies are coupled to said each spinal board at locations separate from the longitudinal axis of the bottom evacuation sheet, and wherein one of the at least five wheel-axle assemblies is coupled to said each spinal board at a location substantially adjacent the longitudinal axis of the bottom evacuation sheet.

7. The evacuation device according to claim 1, wherein the plural spinal boards comprise five spinal boards.

8. The evacuation device according to claim 7, wherein at least four wheel-axle assemblies are coupled to each spinal board.

9. The evacuation device according to claim 7, wherein at least five wheel-axle assemblies are coupled to each spinal board.

10. The evacuation device according to claim 9, wherein four of the at least five wheel-axle assemblies are coupled to said each spinal board at locations separate from the longitudinal axis of the bottom evacuation sheet, and wherein one of the at least five wheel-axle assemblies is coupled to said each spinal board at a location substantially adjacent the longitudinal axis of the bottom evacuation sheet.

11. The evacuation device according to claim 1, further comprising a braking structure configured to brake one or more of the plurality of wheel-axle assemblies.

12. The evacuation device according to claim 1, wherein each of said plurality of wheel-axle assemblies is affixed to one of said plural spinal boards.

13. An evacuation device comprising:

a top evacuation sheet configured to be deployed over a patient who is disposed on a mattress, while leaving the patient's head exposed;

a bottom evacuation sheet configured to be deployed underneath at least a portion of the mattress;

securing structure configured to secure the top evacuation sheet to the bottom evacuation sheet;

plural spinal boards coupled to said bottom evacuation sheet and configured to support the patient and mattress, said plural spinal boards being disposed substantially perpendicular to a longitudinal axis of the bottom evacuation sheet;

four wheel-axle assemblies coupled to a first spinal board and extending through holes in the bottom evacuation sheet, the four wheel-axle assemblies being disposed in two columns with respect to the longitudinal axis of the bottom evacuation sheet; and five wheel-axle assemblies coupled to a second spinal board and extending through holes in the bottom evacuation sheet, the five wheel-axle assemblies being disposed in three columns with respect to the longitudinal axis of the bottom evacuation sheet.

14. The evacuation device according to claim 13, wherein the plural spinal boards are disposed more toward a head of the bottom evacuation sheet than a foot thereof.

15. The evacuation device according to claim 13, wherein the plural spinal boards comprise four spinal boards.

16. The evacuation device according to claim 13, wherein the plural spinal boards comprise five spinal boards.

17. The evacuation device according to claim 13, wherein four of the five wheel-axle assemblies are coupled to said second spinal board at locations separate from the longitudinal axis of the bottom evacuation sheet, and wherein one of the five wheel-axle assemblies is coupled to said second spinal board at a location substantially adjacent the longitudinal axis of the bottom evacuation sheet.

18. The evacuation device according to claim 13, wherein the device comprises 20 wheel-axle assemblies.

19. An patient-mattress evacuation device comprising:

a top evacuation sheet configured to be deployed over at least a portion of a patient who is lying on a mattress, while leaving the patient's head uncovered;

a bottom evacuation sheet configured to be deployed underneath at least a portion of the mattress;

securing structure configured to secure the top evacuation sheet to the bottom evacuation sheet;

at least four spinal boards coupled to said bottom evacuation sheet and configured to support the patient and mattress, said at least four spinal boards being disposed substantially perpendicular to a longitudinal axis of the bottom evacuation sheet; and at least five wheel-axle receptacles affixed to each spinal board and extending through corresponding holes in the bottom evacuation sheet, the at least five wheel-axle receptacles being disposed in at least three columns with respect to a direction perpendicular to the longitudinal axis of the bottom evacuation sheet.

20. The evacuation device according to claim 19, wherein the at least four spinal boards are disposed more toward a head of the bottom evacuation sheet than a foot thereof.

* * * * *